US007866490B1

(12) United States Patent
Bellis, Jr.

(10) Patent No.: US 7,866,490 B1
(45) Date of Patent: Jan. 11, 2011

(54) METHOD FOR STORING GARDEN TRIMMERS

(76) Inventor: William B. Bellis, Jr., 1401 Schuff La., Louisville, KY (US) 40205

( * ) Notice: Subject to any disclaimer, the term of this patent is extended or adjusted under 35 U.S.C. 154(b) by 332 days.

(21) Appl. No.: 11/950,807

(22) Filed: Dec. 5, 2007

Related U.S. Application Data

(60) Provisional application No. 60/884,305, filed on Jan. 10, 2007.

(51) Int. Cl.
*A47F 7/00* (2006.01)

(52) U.S. Cl. ..... 211/70.6; 211/4

(58) Field of Classification Search ..... 211/70.6, 211/7, 85.6, 85.7, 60.1, 62, 64, 68, 70.2, 211/70.4, 70.5, 70.8, 4, 89.01; 224/401, 224/403, 405, 569, 324, 404; 312/245, 283; 70/61, 62
See application file for complete search history.

(56) References Cited

U.S. PATENT DOCUMENTS

| | | | | |
|---|---|---|---|---|
| 326,193 | A * | 9/1885 | Barber | 211/65 |
| 1,914,276 | A | 6/1933 | Moore | |
| 2,070,904 | A * | 2/1937 | Jennings | 211/64 |
| 3,917,137 | A | 11/1975 | Wilkins | |
| 4,523,704 | A * | 6/1985 | Washington | 224/328 |
| 4,583,647 | A * | 4/1986 | Schinzing | 211/60.1 |
| 5,381,907 | A | 1/1995 | Stukuls | |
| 5,405,226 | A * | 4/1995 | Daves | 410/32 |
| 5,647,489 | A | 7/1997 | Bellis, Jr. | |
| 5,819,933 | A * | 10/1998 | Hernandez | 206/373 |
| 6,390,307 | B1 * | 5/2002 | Stelter | 211/60.1 |
| 6,719,153 | B2 * | 4/2004 | Heneveld | 211/70.6 |
| 6,742,789 | B1 * | 6/2004 | Nowak | 280/47.26 |
| 6,910,592 | B1 * | 6/2005 | Lindenmeyer | 211/70.8 |
| 7,322,149 | B1 * | 1/2008 | Quintero | 43/26 |
| 2006/0070292 | A1 * | 4/2006 | Fitzgerald | 43/54.1 |

* cited by examiner

*Primary Examiner*—Darnell M Jayne
*Assistant Examiner*—Stanton L Krycinski
(74) *Attorney, Agent, or Firm*—Theresa Fritz Camoriano; Camoriano and Associates

(57) ABSTRACT

A method for storing and protecting a garden trimmer includes mounting the trimmer horizontally on a rack and enclosing the power head of the trimmer in a rigid box enclosure at the forward end of the rack with the shaft and trimmer head projecting rearwardly outside of the box enclosure and being open and accessible from the outside.

3 Claims, 8 Drawing Sheets

METHOD FOR STORING GARDEN TRIMMERS

This application claims priority from U.S. Provisional Application Ser. No. 60/884,305 filed Jan. 10, 2007.

BACKGROUND

The present invention relates to a method for storing and protecting garden trimmers.

U.S. Pat. No. 5,647,489 "Bellis", which is hereby incorporated herein by reference, describes a rack for securing and transporting tubular members, such as string trimmers and other powered equipment, and includes first and second uprights, each of which includes hooks and retaining members for retaining the tubular members on the hooks. The rack is generally intended to be installed on a trailer, as shown in the reference and in FIGS. 1 and 2 herein, which are labeled "Prior Art", although it could be installed in other places as well.

When the trailer is being driven from one location to the next, especially in inclement weather such as during a rainstorm, moisture may be driven into sensitive areas of the powered equipment, which may damage the equipment or make it difficult to start the equipment upon arrival at the new location.

SUMMARY

The present invention provides a method for storing garden trimmers that makes them easily accessible while providing protection for the weather-sensitive power head.

DESCRIPTION

Figure 1:
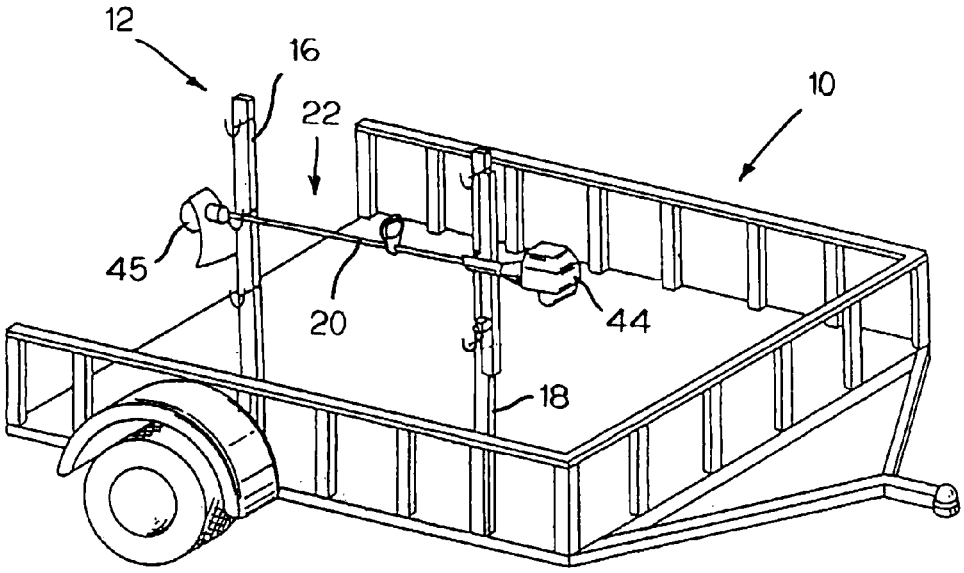
PRIOR ART FIG. 1
FIG. 1 is a perspective view of a prior art rack, mounted on a trailer.
Figure 2:
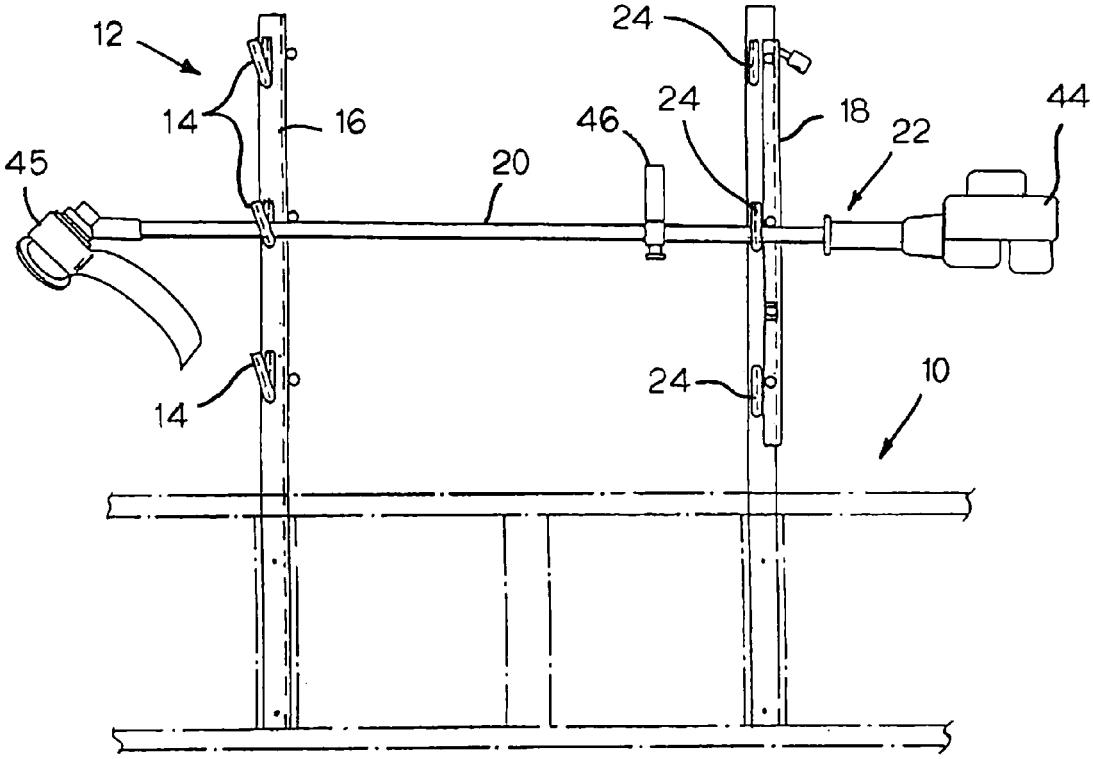
PRIOR ART FIG. 2
FIG. 2 is a side view, partially broken away, of the prior art rack of FIG. 1 with the outline of a trailer body shown in phantom.

FIGS. 1 and 2 show a trailer 10 with a prior art rack 12 mounted on the trailer 10. The rack 12 includes a rear upright 16 and a front upright 18, as described in detail in the aforementioned U.S. Pat. No. 5,647,489 "Bellis". Each of the garden trimmers 22 has a power head 44 connected to a trimmer head 45 by means of an elongated shaft 20. For purposes of this description, the end of the power head toward the shaft 20 is the rear end of the power head, and the end directed away from the shaft is the front end of the power head. Each rear upright 16 has a plurality of hooks 14 that serve as receptacles to receive the elongated shaft 20 of the powered garden trimmer 22, and each forward upright 18 has hooks 24 that are horizontally aligned with the hooks 14 in the rear upright 16. The forward hooks 24 serve as receptacles to receive the forward portion of the shaft 20 of the powered garden trimmer 22. The forward hooks 24 and the rear hooks 14 are located between the power head 44 and the trimmer head 45.

Figure 3:
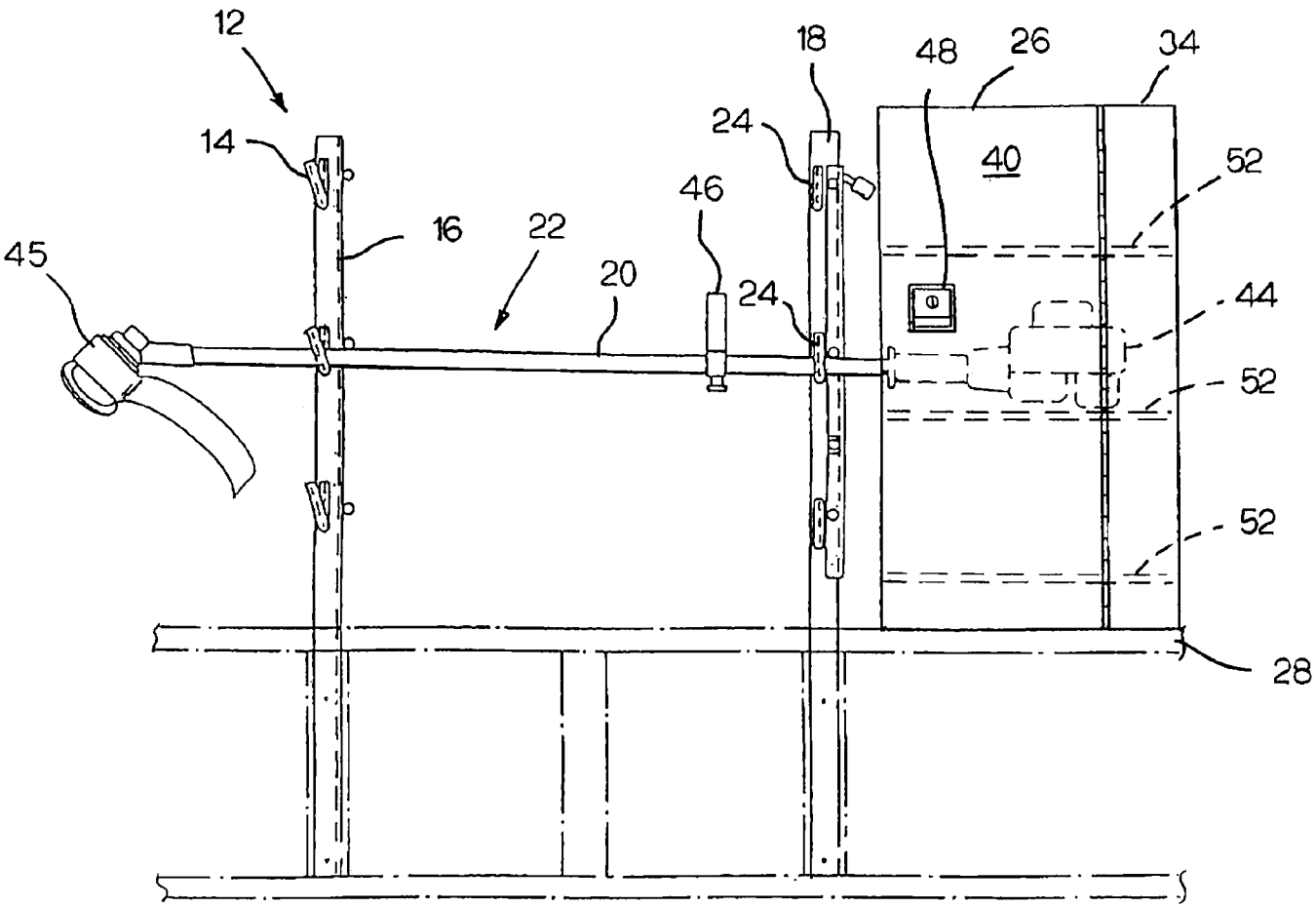
FIG. 3 is a side view, similar to that of FIG. 2, but for a rack that provides an enclosure for the power head that has been retrofitted onto an existing rack installation.

FIG. 3 depicts a trailer 10 with the same rack 12 shown in FIGS. 1 and 2, but which has been retrofitted with a rigid box enclosure 26, which is mounted adjacent the front upright 18 to protect the power head 44. In this embodiment, the rigid box enclosure 26 is shown mounted onto the top rail 28 of the trailer 10. However, the enclosure 26 may be mounted onto the upright 18, or onto the trailer 10, or both.

Figure 5:
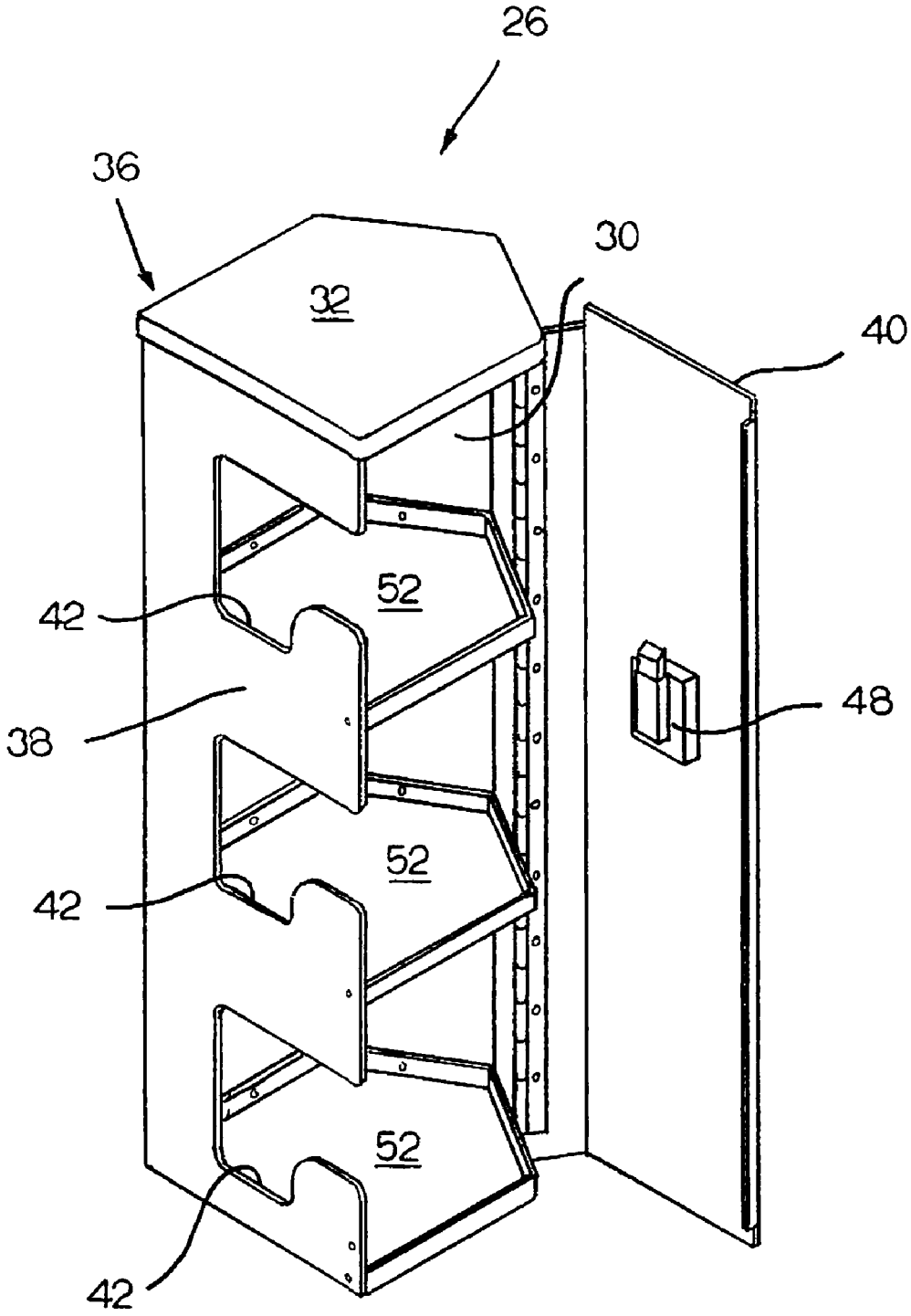
FIG. 5 is a perspective view of the enclosure of FIG. 4.

FIG. 5 depicts the rigid box enclosure 26, which includes a top 32, front side 30, left side 36, a rear side 38, and a right side 34, which includes a hinged door 40. In this embodiment, the box enclosure 26 is made of rigid sheet metal panels. The front, part of the right side, the left side, and the rear side are formed of a single sheet of metal that has been bent. The rear wall 38 defines a plurality of hook-shaped slotted openings 42, which extend to the door opening to receive the tubular handles 20 of the powered equipment 22. (See also FIGS. 3 and 6) These hook-shaped slotted openings 42 include a horizontal portion extending to the door opening on the right side and a vertical portion on the left side, with the vertical portion extending downwardly to a lower elevation than the horizontal portion. The left-to-right dimension of the vertical portion is just larger than the diameter of the shaft 20, in order to substantially limit any horizontal movement of the shaft 20 relative to the box enclosure 26 once the shaft 20 is resting at the bottom of the vertical portion of the slot. As is explained in more detail later, the rear wall 38 of the box enclosure 26 may have a number of different configurations, some of which are depicted in FIGS. 6-9.

The cover 26 of FIG. 3 is a solid-walled enclosure. This particular embodiment is made of aluminum diamond tread plate, but it could be made of plastic or other suitable materials. A similarly-shaped rigid box cover alternatively could be made by using a rigid framework covered by a soft, cloth-like material such as an impermeable canvas or a vinyl. This embodiment, and the framework embodiment (not shown), are rigid enough to keep their shape without needing any other structural support, so they can be mounted independently of the forward upright 18. The box enclosure 26 could be mounted forward of the forward upright 18, as shown in FIG. 3, or abutting or enclosing that upright (not shown), if desired. While solid walls are preferred, there may be some openings as long as the enclosure 26 encloses the top, front, and left and right sides of the power head enough to protect it from rain when the trailer is stationary and when it is moving.

Figure 13:
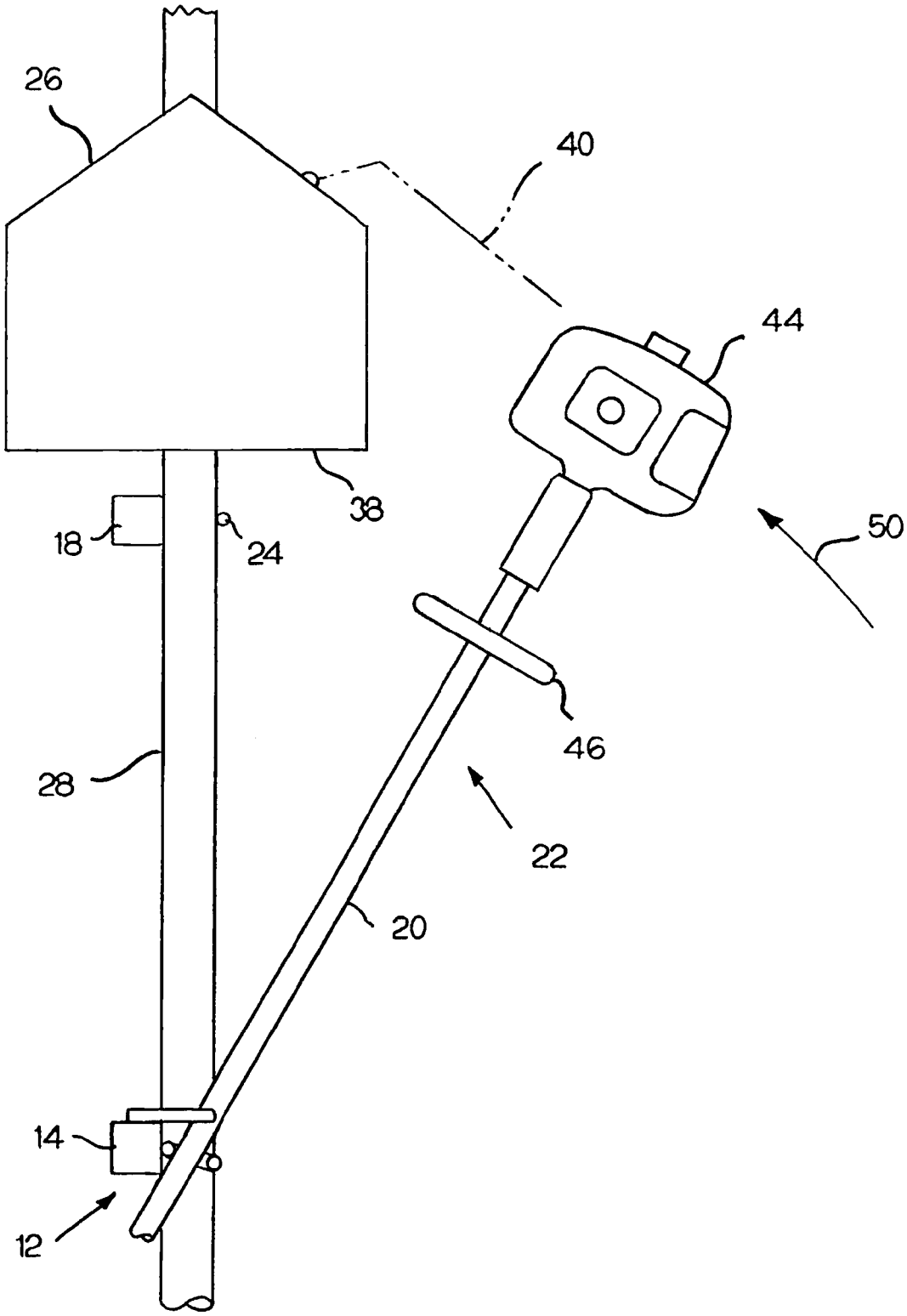
FIG. 13 is a broken away, plan view of the embodiment of FIG. 3, with the powered equipment shown as it is being mounted onto the rack, with the door to the enclosure, shown in phantom, in an open position.

As shown in FIG. 13, to mount the trimmer 22 on this rack, the door 40 is opened, and the trimmer 22 is mounted onto one of the hooks 14 on the rear upright 16 of the rack 12 and then is pivoted to the left, in the direction of the arrow 50, toward the front upright 18, as taught in U.S. Pat. No. 5,647,489. The power head 44 enters into the box enclosure 26, with the shaft 20 entering into the open right side of the horizontal portion of the slotted opening 42 and then moving to the vertical portion and finally moving downwardly into the lower elevation of the vertical portion of the slotted opening 42, with the shaft 20 projecting out the back wall 38 through the slotted opening 42 (shown in FIGS. 5 and 6) and resting on its respective hook 24 in the front upright 18. (The latching mechanism on the front upright 18 may be used, if desired, or it may be removed and the enclosure 26 may be used to secure the trimmer 22.) Once the shaft 20 is resting on both hooks 14, 24, and the power head 44 is inside the enclosure 26, with the trimmer 22 mounted in the horizontal position, the door 40 is closed. The door 40 includes a latch 48 that permits it to be secured in the closed position and locked if desired. Alternative latches may include a latch with a pivoting handle and a vertical rod similar to what is often used for closing a file cabinet, or a hasp and a padlock, a doorknob, or various other known types of latches used for closing or securing doors.

While the power head 44 is enclosed within the enclosure 26, the rest of the trimmer 22 is outside of the enclosure 26 and easily accessible from the outside, including the majority of the shaft 20 and the cutting head 45. The handle 46 of the trimmer 22 is also outside of the enclosure 26, lying between the forward and rear uprights 18, 16, as shown in FIG. 3.

Figure 4:
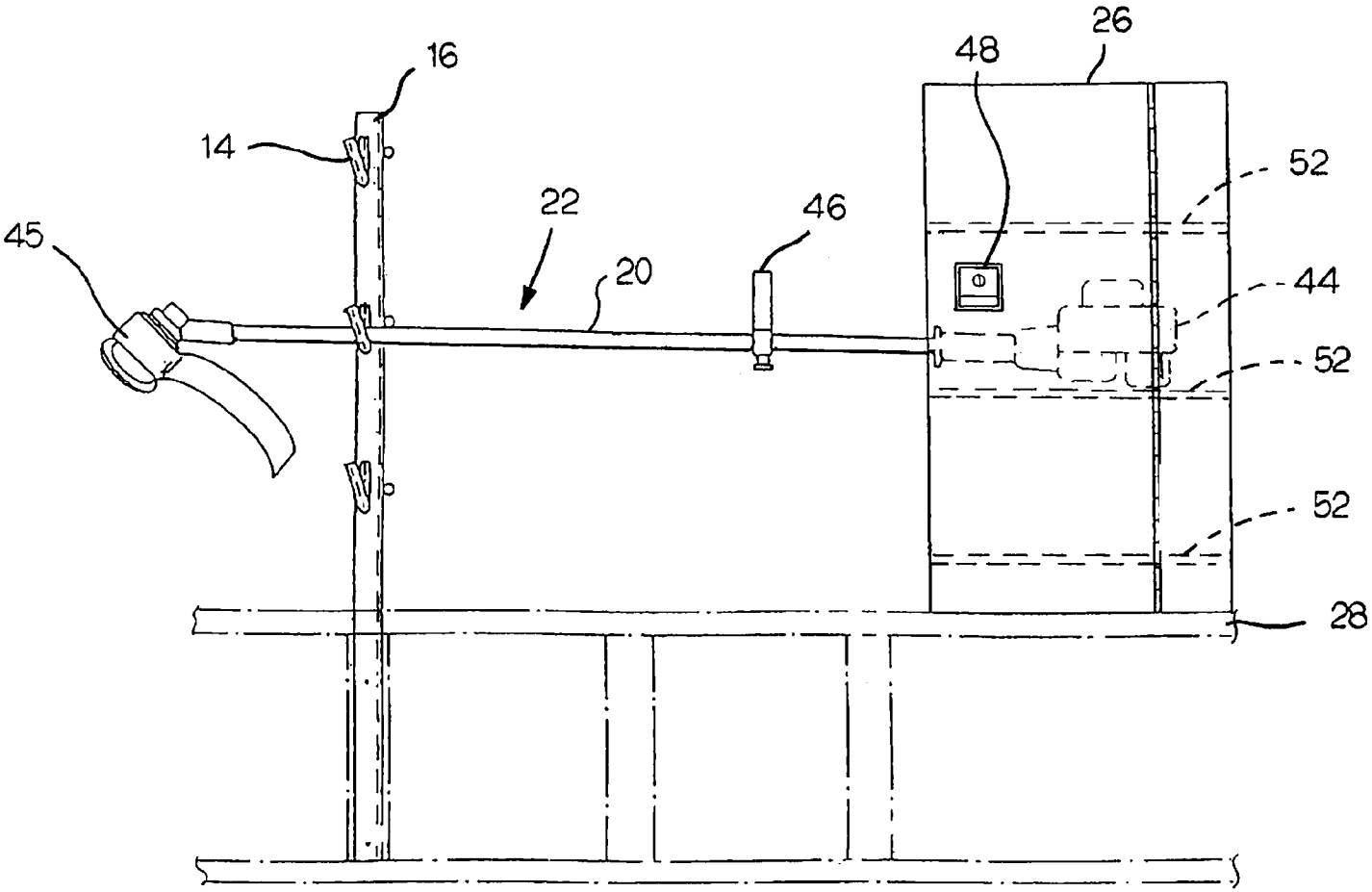
FIG. 4 is a side view, similar to that of FIG. 3, but for another embodiment of a rack with an enclosure that encloses the power head.

While the box enclosure 26 may be added as a retrofit to an existing rack, as described above, it alternatively may be made as an integral part of a new rack, as shown in FIG. 4. In the embodiment of FIG. 4, the forward upright is incorporated into the structure of the box enclosure 26, so, in this embodiment, the box enclosure 26 provides support for the power head end of the trimmer 22.

In the arrangement shown in FIG. 4, the box enclosure 26 is identical to the box enclosure 26 of FIG. 3, but the separate front upright 18 has been eliminated. The power heads 44 may rest on the shelves 52, or the shafts 20 may rest on the bottoms of the vertical portions of the slots 42 on the rear wall 38 of the box enclosure 26 to provide support for the power head end of the trimmers 22. The vertical portions of the hook-shaped slotted openings 42 trap the shafts 20 of the powered equipment 22 (See FIG. 6) to prevent left-to-right movement of the equipment 22 relative to the rack, providing in large measure the securing means that the hooks 24 provided in the front upright 18 of the previous embodiment.

In both the embodiment of FIG. 3 and the embodiment of FIG. 4, to remove the powered equipment 22 from the rack, the door 40 is opened, the power head 44 is then lifted slightly to raise the shaft 20 to the elevation of the horizontal portion of the hook-shaped slotted opening 42, and the power head 44 of the powered equipment 22 is swung to the right, in a direction opposite to the arrow 50 (of FIG. 13), reversing the process that was used to install it. Of course, if the door 40 is locked in the closed position, it would have to be unlocked before it could be opened and the trimmer removed. This would provide security to prevent the trimmer 22 from being stolen from the rack when it is unattended. Of course, the same installation and removal process would be repeated for each trimmer on the rack. FIGS. 3 and 4 show only a single trimmer 22, but it is clear that the racks in those two embodiments are intended to hold three trimmers 22, one directly above the other.

Figures 6, 7, 8, 9:
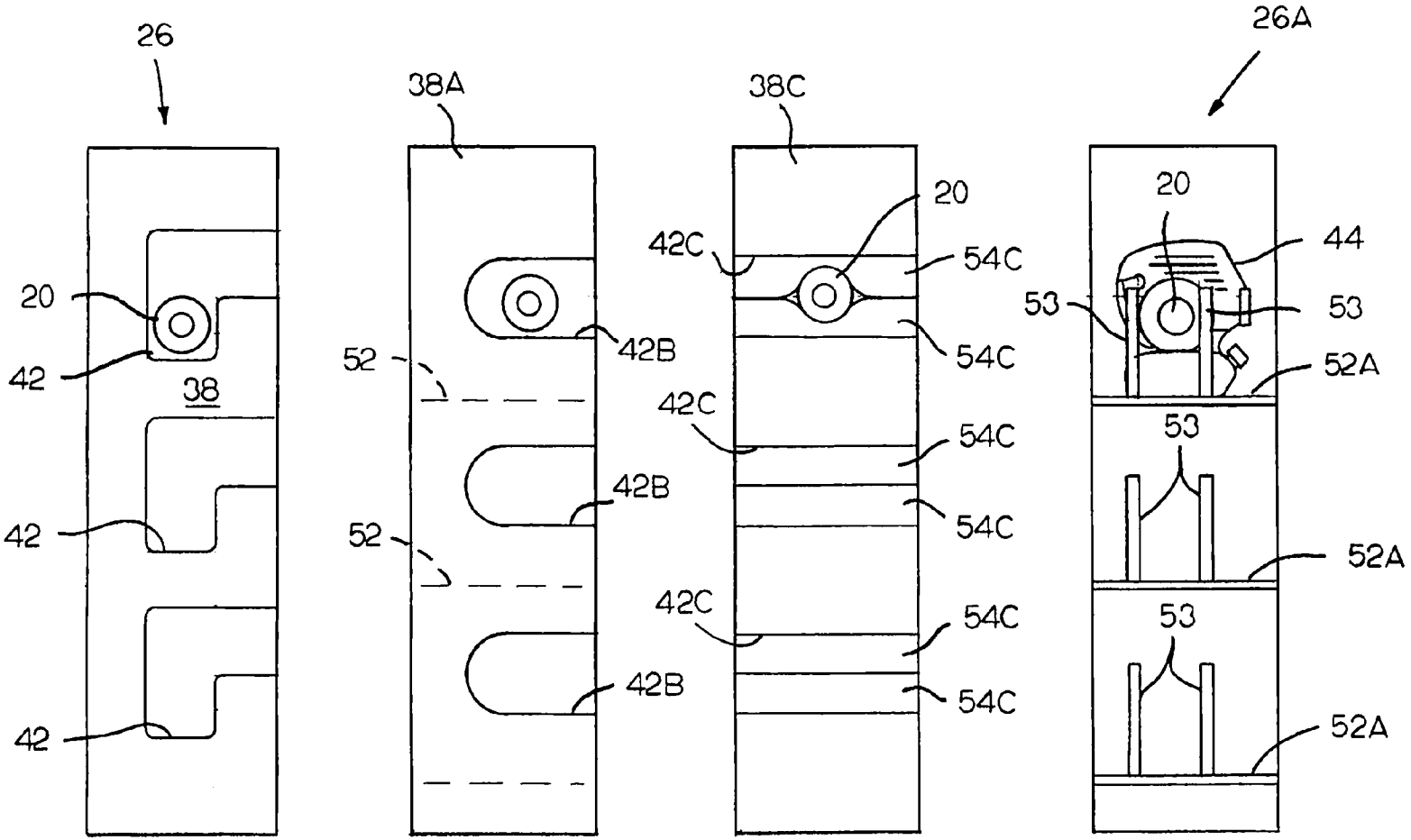
FIG. 6 is an end view of the rear wall of the enclosure of FIG. 5.
FIG. 7 is similar to that of FIG. 6 but for another embodiment of an enclosure with a differently-shaped opening.
FIG. 8 is similar to FIG. 6 but for another embodiment of an enclosure, with a straight slot and overlapping rubber flaps.
FIG. 9 is similar to FIG. 6 but for another embodiment of an enclosure, which is completely open in the rear.

FIG. 9 depicts an embodiment of a box enclosure 26A which is shaped similarly to that of FIG. 5, except that it has a solid right wall instead of a door, and there is no rear wall 38. It can be used with or without a separate forward upright 18. In this embodiment, the rear of the enclosure 26A is totally open while the front, left, and right sides, top and bottom are completely enclosed. Shelves 52A are provided in the enclosure 26A, and the power head 44 of the powered equipment 22 rests on its respective shelf 52A, with the shaft 20 projecting out the open back of the enclosure 26A.

If the front upright 18 is not present, it is preferred that there be some way of securing the equipment to the enclosure so it does not slide around. In this embodiment, there are upward projections 53 from the shelves 52A located on the left and right sides of the shaft 20 and to the rear of the power head 44 that prevent the equipment from sliding left and right and prevent the power head 44 from sliding out the open back side of the enclosure 26A. These projections also serve as part of the receptacle for receiving the powered equipment 22.

To install the trimmer 22 in this embodiment, the shaft 20 is first mounted on its respective hook 14 on the rear upright 16. Then the tool 22 is swung to the left to align the power head 44 with the rear of the enclosure 26A. Then the tool is slid forward until the power head 44 is at a higher elevation than and forward of the upward projections 53, and then the power head 44 is lowered until it rests on the shelf 52A, forward of the projections 53, with the shaft 20 extending between the projections 53.

FIGS. 7 and 8 depict possible alternative configurations for the rear wall of the enclosure 26. These embodiments preferably are intended to be used without the separate forward column 18 and its respective hooks 24. These embodiments may include shelves 52, as shown in FIG. 5, to support the power head 44, or they may rely on the rear wall 38 to support the power head end of the trimmer 22.

In FIG. 7, the slots 42B are straight horizontal slots extending to the door opening.

FIG. 8 also has straight horizontal slots 42C, but adds upper and lower rubber flaps 54C, extending along the top and bottom edges of each slotted opening 42C, to help seal off the slots 42C, so the shaft 20 of the tool 22 deforms the rubber flaps 54C in order to enter its respective slot 42C, and the rubber flaps 54C close around the shaft 20 to provide both further sealing of the enclosure 26C to prevent water from reaching the power head 44, and to provide frictional resistance to horizontal movement of the power head 44 inside the enclosure.

It should be noted that, in the embodiments of FIGS. 6-8, the slots are small enough that they do not permit the power head 44 to pass through, only the shaft 20.

Figure 10:
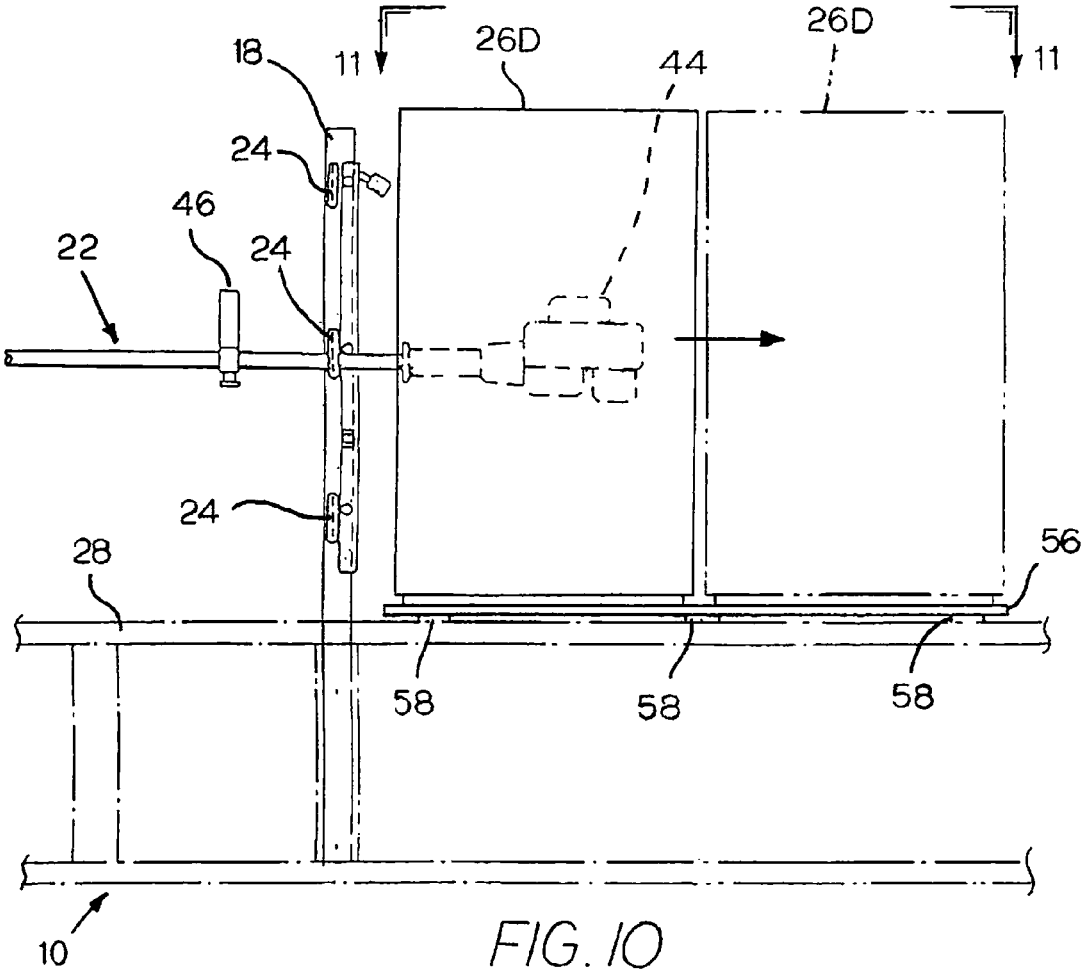
FIG. 10 is a side view, similar to that of FIG. 3, but for another embodiment of a rack with an enclosure, where the enclosure slides out on a track (shown in phantom in the slid-out position)
Figure 11:
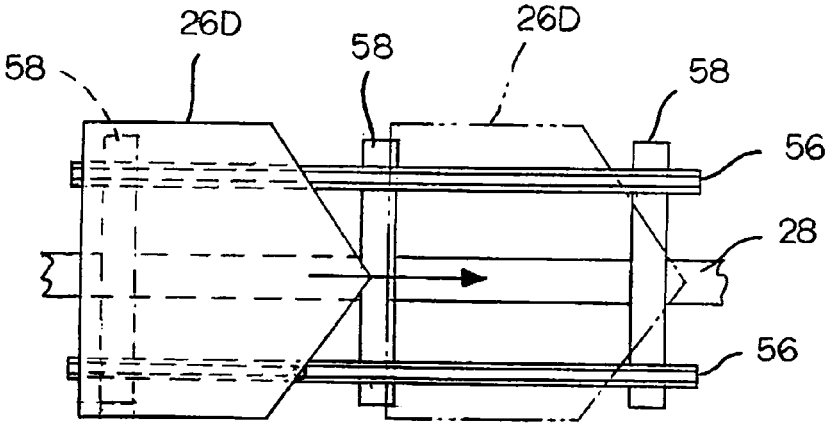
FIG. 11 is a view along line 11-11 of FIG. 10.

FIGS. 10 and 11 depict yet another embodiment of a rack, in which the box enclosure 26D slides forward (in the direction of the arrow in FIG. 10) on tracks 56 supported off of brackets 58 on the top rail 28 of the trailer 10 to permit the power head end of the trimmer 22 to be mounted on the forward column 18. When the box enclosure 26D is in the forward position (shown in phantom in FIGS. 10 and 11), it is entirely forward of the power head 44 of the powered equipment 22 so that the powered equipment 22 may be removed from (or mounted onto) the forward and rear columns 18, 16.

In this instance, the box enclosure 26D provides no structural support for the powered equipment 22. The rear of the box enclosure 26D is completely open, as in FIG. 9. The shelves 52A shown in FIG. 9 may be omitted from this embodiment if desired, as the power head 44 is not supported by the enclosure 26D. There is also no need for a door or for a door latch. The enclosure 26D may be locked in the slid-back position to protect the powered equipment 22 from theft, or the lock on the rack itself may be relied on to prevent theft.

Figure 12:
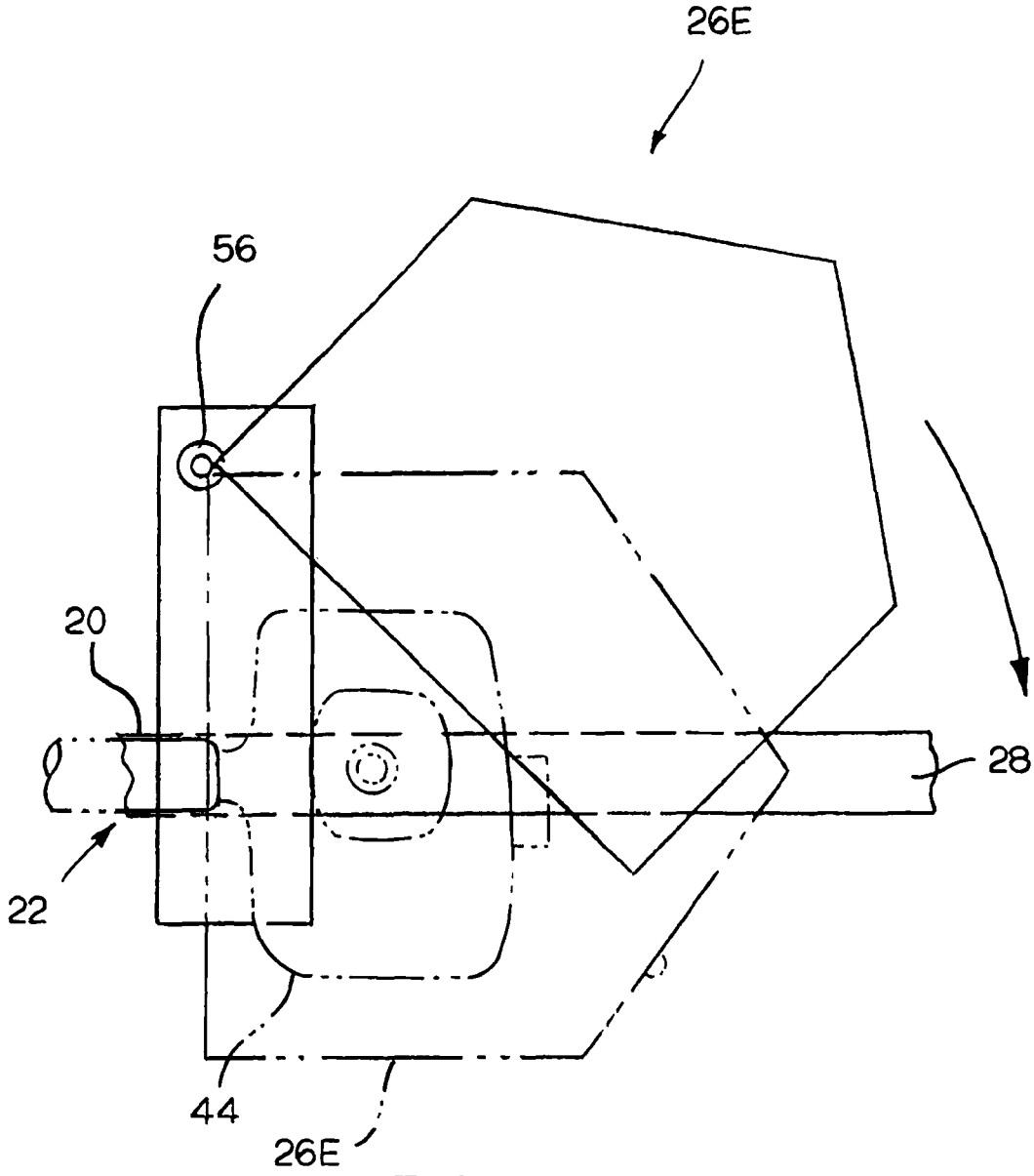
FIG. 12 is a top view, similar to that of FIG. 11, but for still another embodiment of an enclosure, where the entire enclosure hinges open.

FIG. 12 depicts yet another embodiment in which the box enclosure 26E is shaped like the box enclosure 26A of FIG. 9 but without the uprights 53. It has an open back and no separate door. This box enclosure 26E has a vertical hinge 56, which allows the entire box enclosure 26E to swing or pivot open, out of the way, to clear the power head 44 of the trimmer 22, which is supported on front and rear columns 18, 16. It may include a latch or lock to retain it in the swung-closed position (shown in phantom in FIG. 12). In this embodiment, the enclosure 26E would be swung open, the trimmer 22 would be mounted on the forward and rear columns 18, 16 in a horizontal position as described earlier, and then the enclosure 26E would be swung closed to enclose the top, front, left and right sides of the power head 44.

While it is preferred that the box enclosure be mounted toward the front of the trailer and the rear column 16 of the rack toward the rear of the trailer, it would be possible to mount the box enclosure toward the rear of the trailer and the rear column 16 toward the front of the trailer. In this case, it would be preferred to use an embodiment like that in FIG. 8, to provide as much protection as possible to the power head 44.

While the embodiments described above show several arrangements for mounting a trimmer, it will be obvious to those skilled in the art that modifications could be made to these arrangements without departing from the scope of the present invention as claimed.

What is claimed is:

1. A method for storing and protecting a garden trimmer having a power head and a trimmer head connected together by an elongated shaft, comprising the steps of:

mounting the trimmer horizontally on a rack having forward and rear spaced-apart columns providing forward and rear support, respectively; and enclosing the top, front, and left and right sides of the power head in a rigid box enclosure at the forward end of the rack, with the shaft and trimer head projecting rearwardly outside of the box enclosure and being open and accessible from the outside, wherein said box enclosure defines a front side, a rear side, a left side and a right side, wherein one of said left and right sides defines a door opening, and said rear side defines an shaped slotted opening including a horizontal leg extending to said door opening and a vertical leg extending from said horizontal leg, and including the step of moving the power head through the door opening; and moving the shaft through the door opening and into the horizontal portion of said slot, then moving the shaft downwardly into the vertical leg of the slot until the power head rests on a shelf in said enclosure.

2. A method for storing and protecting a garden trimmer as recited in claim 1, wherein said box enclosure includes means for protecting the power head from rain.

3. A method for storing and protecting a garden trimmer having a power head and a trimmer head connected together by an elongated shaft as recited in claim 2, and including the step of closing said door opening after the power head is inside the enclosure.

* * * * *

UNITED STATES PATENT AND TRADEMARK OFFICE

CERTIFICATE OF CORRECTION

PATENT NO. : 7,866,490 B1
APPLICATION NO. : 11/950807
DATED : January 11, 2011
INVENTOR(S) : William B. Bellis, Jr.

It is certified that error appears in the above-identified patent and that said Letters Patent is hereby corrected as shown below:

Column 6, claim 1, line 10, delete “trimer” and insert therefor --trimmer--.
Column 6, claim 1, line 15, delete “defines an shaped slotted opening” and insert therefor --defines an L-shaped slotted opening--.

Signed and Sealed this
Eighth Day of March, 2011

David J. Kappos

David J. Kappos
*Director of the United States Patent and Trademark Office*